US010711350B2

(12) United States Patent
Duan et al.

(10) Patent No.: US 10,711,350 B2
(45) Date of Patent: Jul. 14, 2020

(54) ALUMINA LAYER FORMATION ON ALUMINUM SURFACE TO PROTECT ALUMINUM PARTS

(71) Applicant: Applied Materials, Inc., Santa Clara, CA (US)

(72) Inventors: Ren-Guan Duan, Fremont, CA (US); Jianhua Zhou, Campbell, CA (US); Juan Carlos Rocha-Alvarez, San Carlos, CA (US)

(73) Assignee: APPLIED MATERICAL, INC., Santa Clara, CA (US)

( * ) Notice: Subject to any disclaimer, the term of this patent is extended or adjusted under 35 U.S.C. 154(b) by 429 days.

(21) Appl. No.: 15/437,098

(22) Filed: Feb. 20, 2017

(65) Prior Publication Data

US 2017/0275763 A1 Sep. 28, 2017

Related U.S. Application Data

(60) Provisional application No. 62/312,254, filed on Mar. 23, 2016.

(51) Int. Cl.
*C23C 18/12* (2006.01)
*C22F 1/04* (2006.01)
(Continued)

(52) U.S. Cl.
CPC ..... *C23C 18/1295* (2013.01); *C22F 1/04* (2013.01); *C23C 18/04* (2013.01); *C23C 18/1279* (2013.01); *C23G 1/125* (2013.01)

(58) Field of Classification Search
CPC . C23C 18/04; C23C 18/1279; C23C 18/1295; C23G 1/125; C22F 1/04
See application file for complete search history.

(56) References Cited

U.S. PATENT DOCUMENTS 3,247,026 A * 4/1966 Switzer ..... B05D 3/10 148/275
3,551,122 A * 12/1970 Gulla ..... A01D 23/06 428/641

(Continued)

FOREIGN PATENT DOCUMENTS

JP 06264111 A * 9/1994
JP H0835052 A 2/1996
JP 2009234803 A 10/2009

OTHER PUBLICATIONS

International Search Report and Written Opinion in International Application No. PCT/US2017/018567 dated May 31, 2017.

*Primary Examiner* — Nathan H Empie
(74) *Attorney, Agent, or Firm* — Patterson + Sheridan, LLP

(57) ABSTRACT

Implementations described herein generally relate to materials and coatings, and more specifically to materials and coatings for aluminum and aluminum-containing chamber components. In one implementation, a process is provided. The process comprises exposing an aluminum-containing component to a moisture thermal treatment process and exposing the aluminum-containing component to a thermal treatment process. The moisture thermal treatment process comprises exposing the aluminum-containing component to an environment having a moisture content from about 30% to about 100% at a first temperature from about 30 to about 100 degrees Celsius. The thermal treatment process comprises heating the aluminum-containing component to a second temperature from about 200 degrees Celsius to about 550 degrees Celsius to form an alumina layer on the at least one surface of the aluminum-containing component.

19 Claims, 8 Drawing Sheets

(51) Int. Cl.
*C23C 18/04* (2006.01)
*C23G 1/12* (2006.01)

(56) References Cited

U.S. PATENT DOCUMENTS

| | | | | |
|---|---|---|---|---|
| 3,859,058 | A * | 1/1975 | Anthony | B32B 15/016 428/629 |
| 4,141,484 | A * | 2/1979 | Hamilton | B23K 20/00 228/173.2 |
| 2002/0016009 | A1* | 2/2002 | Ogura | G01N 21/253 436/518 |
| 2003/0183625 | A1* | 10/2003 | Hoh | A47J 36/027 219/732 |
| 2005/0274320 | A1* | 12/2005 | Murugesh | C23C 16/4404 118/715 |
| 2009/0297718 | A1 | 12/2009 | Sarrafi-Nour et al. | |
| 2012/0070574 | A1 | 3/2012 | Zhang et al. | |
| 2012/0104703 | A1 | 5/2012 | Sun et al. | |
| 2014/0190937 | A1 | 7/2014 | Tan | |
| 2014/0263272 | A1 | 9/2014 | Duan et al. | |
| 2014/0274653 | A1 | 9/2014 | Duan et al. | |
| 2015/0201461 | A1 | 7/2015 | Duan et al. | |
| 2015/0221480 | A1 | 8/2015 | Duan et al. | |
| 2015/0251961 | A1 | 9/2015 | Duan et al. | |
| 2015/0275375 | A1 | 10/2015 | Kim et al. | |
| 2015/0376780 | A1 | 12/2015 | Khaja et al. | |
| 2016/0017263 | A1 | 1/2016 | Duan et al. | |

* cited by examiner

ALUMINA LAYER FORMATION ON ALUMINUM SURFACE TO PROTECT ALUMINUM PARTS

CROSS-REFERENCE TO RELATED APPLICATIONS

This application claims benefit of U.S. Provisional Patent Application Ser. No. 62/312,254, filed Mar. 23, 2016, which is incorporated herein by reference in its entirety.

BACKGROUND

Field

Implementations described herein generally relate to materials and coatings, and more specifically to materials and coatings for aluminum and aluminum-containing chamber components.

Description of the Related Art

Semiconductor processing often utilizes plasma processing to etch or clean semiconductor wafers. Predictable and reproducible wafer processing is facilitated by plasma processing parameters that are stable and well controlled. Certain changes to equipment and/or materials involved in plasma processing can temporarily disrupt stability of plasma processing. For example, introducing a material to a plasma chamber that is unstable in the plasma-processing environment, switching among plasma processes performed in the plasma chamber, exposing the chamber to different gases or plasmas than usual, and/or replacing components that are part of or within the plasma chamber may disrupt process stability. In such cases, the process may change substantially when disrupted, but may stabilize over time. For example, when an introduced material gradually clears from the process chamber or when surface coatings within the process chamber come into equilibrium with the plasma process conditions.

In the case of aluminum and aluminum-containing components, elements of the aluminum-containing components may migrate to the component surface at high temperatures resulting in non-uniformity, particles and contamination issues. These non-uniformity and contamination issues can lead to decreased chamber performance including increased chamber processing time and increased chamber downtime.

Therefore, what is needed is a method to prevent decreases in processing chamber performance over time.

SUMMARY

Implementations described herein generally relate to materials and coatings, and more specifically to materials and coatings for aluminum and aluminum-containing chamber components. In one implementation, a process is provided. The process comprises exposing an aluminum-containing component to a moisture thermal treatment process and then exposing the aluminum-containing component to a thermal treatment process. The moisture thermal treatment process comprises exposing the aluminum-containing component to an environment having a moisture content from about 30% to about 100% at a first temperature from about 30 to about 100 degrees Celsius. The thermal treatment process comprises heating the aluminum-containing component to a second temperature from about 200 degrees Celsius to about 550 degrees Celsius to form an alumina layer on the at least one surface of the aluminum-containing component.

In another implementation, a process is provided. The process comprises exposing an aluminum-containing component to a wet clean solution including nitric acid ($HNO_3$) and hydrofluoric acid (HF). The process further comprises exposing the aluminum-containing component to a moisture thermal treatment process. The moisture thermal treatment process comprises exposing the aluminum-containing component to an environment having a moisture content from about 30% to about 100% at a first temperature from about 30 to about 100 degrees Celsius. The process further comprises exposing the aluminum-containing component to a thermal treatment process. The thermal treatment process comprises heating the aluminum-containing component to a second temperature from about 200 degrees Celsius to about 550 degrees Celsius to form an alumina layer on the at least one surface of the aluminum-containing component.

In yet another implementation, a process is provided. The process comprises exposing an aluminum-containing component to a wet clean solution including nitric acid ($HNO_3$) and hydrofluoric acid (HF). The process further comprises exposing the aluminum-containing component to a moisture thermal treatment process. The moisture thermal treatment process comprises exposing the aluminum-containing component to an environment having a moisture content from about 30% to about 100% at a first temperature from about 30 to about 100 degrees Celsius. Exposing the aluminum-containing component to the moisture thermal treatment process forms an $Al(OH)_3$/AlOOH layer on the surface of the aluminum-containing component. The process further comprises exposing the aluminum-containing component to a thermal treatment process. The thermal treatment process comprises heating the aluminum-containing component to a second temperature from about 200 degrees Celsius to about 550 degrees Celsius to form an alumina layer on the at least one surface of the aluminum-containing component. The thermal treatment process converts at least a portion of the $Al(OH)_3$/AlOOH layer to the alumina layer.

BRIEF DESCRIPTION OF THE DRAWINGS

So that the manner in which the above-recited features of the present disclosure can be understood in detail, a more particular description of the implementations, briefly summarized above, may be had by reference to implementations, some of which are illustrated in the appended drawings. It is to be noted, however, that the appended drawings illustrate only typical implementations of this disclosure and are therefore not to be considered limiting of its scope, for the disclosure may admit to other equally effective implementations.

Figure 1:
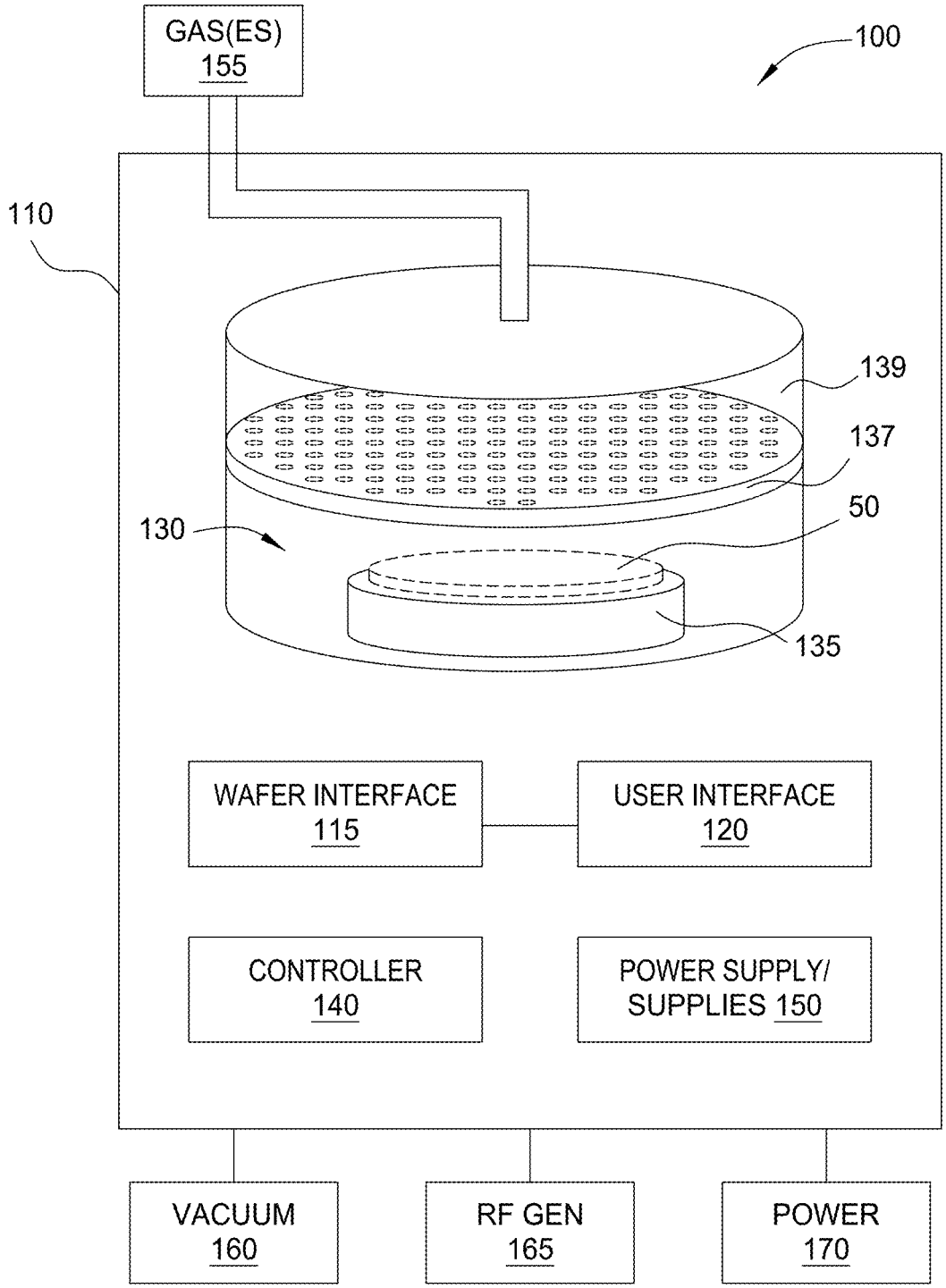
FIG. 1 schematically illustrates elements of a plasma processing system, according to one implementation of the present disclosure.

To facilitate understanding, identical reference numerals have been used, where possible, to designate identical elements that are common to the figures. It is contemplated that elements and features of one implementation may be beneficially incorporated in other implementations without further recitation.

DETAILED DESCRIPTION

The following disclosure describes materials and coatings for aluminum and aluminum-containing chamber components. Certain details are set forth in the following description and in FIGS. 1-8B to provide a thorough understanding of various implementations of the disclosure. Other details describing well-known structures and systems often associated with moisture thermal treatment processes and thermal treatment processes are not set forth in the following disclosure to avoid unnecessarily obscuring the description of the various implementations.

Many of the details, dimensions, angles and other features shown in the Figures are merely illustrative of particular implementations. Accordingly, other implementations can have other details, components, dimensions, angles and features without departing from the spirit or scope of the present disclosure. In addition, further implementations of the disclosure can be practiced without several of the details described below.

Implementations described herein will be described below in reference to a plasma processing system. However, other tools containing aluminum components may also be adapted to benefit from the implementations described herein. The apparatus description described herein is illustrative and should not be construed or interpreted as limiting the scope of the implementations described herein.

During high temperature processing (e.g., temperatures greater than 200 degrees Celsius), magnesium (Mg) present in aluminum alloys (e.g., 6061 aluminum alloy) migrates out to the surface of the aluminum alloy containing component and contaminates the processing chamber resulting in non-uniformity, particles and contamination issues. Therefore, there is a need for methods for a technique to form a layer on aluminum component surface to block the migration of magnesium. Although, current methods of forming a passivation layer on aluminum alloys are able to form passivation layers on the flat surface of the component, these current methods are typically unable to form reliable passivation layers in the smaller features (e.g., holes having a diameter from about 16 mils to about 0.5 millimeters) of the aluminum alloy components. Therefore, there is also a need for layers and methods of forming the layers that can coat not only the flat surface of the aluminum alloy containing components but can also coat the inner surface of holes without blocking the holes.

The implementations of the present disclosure provide methods to form a layer on an inside surface of a hole to protect aluminum material, while increasing aluminum component lifetime and reducing both particle and contamination problems.

Optionally, in one implementation, the aluminum component is exposed to a wet clean process. After the wet clean process, the cleaned aluminum component is loaded into an oven for a moisture thermal treatment (e.g., exposure to $H_2O$). Not to be bound by theory but it is believed that an $Al(OH)_3$/AlOOH layer is formed on the aluminum surface of the aluminum component when moisture (e.g., $H_2O$) damages the natural oxide layer present on the aluminum metal surface by:

$$3H_2O+Al_2O_3=2Al(OH)_3 \quad (1); \text{ and}$$

$$2H_2O+2Al_2O_3=4AlOOH \quad (2)$$

Moisture ($H_2O$) then contacts and continues to react with aluminum metal by:

$$6H_2O+4Al+3O_2=4Al(OH)_3 \quad (3); \text{ and}$$

$$2H_2O+4Al+3O_2=4AlOOH \quad (4).$$

The temperature range during the moisture thermal treatment process is typically in the range of 30-100 degrees Celsius. The moisture content during the moisture thermal treatment process is typically in the range of 30%-100%.

After the moisture thermal treatment process, the treated aluminum component is loaded into an atmosphere oven for thermal treatment. Thermal treatment of the above materials forms an alumina layer by:

$$2Al(OH)_3=Al_2O_3+3H_2O \quad (5); \text{ and}$$

$$2AlOOH=Al_2O_3+H_2O \quad (6).$$

The temperature range during the thermal treatment process is typically in the range of 200-550 degrees Celsius. Dependent on the temperature and time of the thermal treatment process, the formed alumina layer has a thickness in the range of 100 nanometers to 10 micrometers. Optionally, the treated component may be exposed to another wet clean process.

FIG. 1 schematically illustrates major elements of a plasma processing system 100, according to an implementation. The plasma processing system 100 is depicted as a single wafer semiconductor wafer plasma processing system, but it will be apparent to one skilled in the art that the techniques and principles herein are applicable to processing systems for any type of workpiece (e.g., items that are not necessarily wafers or semiconductors). The plasma processing system 100 includes a housing 110 for a wafer interface 115, a user interface 120, a process chamber 130, a controller 140 and one or more power supplies 150. The process chamber 130 includes one or more wafer pedestal(s) 135, upon which wafer interface 115 can place a workpiece 50 (e.g., a semiconductor wafer, but could be a different type of workpiece) for processing. Gas(es) 155 may be introduced into the process chamber 130 through a plenum 139 and a diffuser plate 137, and a radio frequency generator (RF Gen) 165 supplies power to ignite a plasma within the process chamber 130. Surfaces of the wafer pedestal 135, walls and floor of the process chamber 130, and diffuser plate 137 are all surfaces that can significantly affect processing characteristics of the plasma processing system 100. Diffuser plate 137, in particular, has many small holes therethrough to distribute gas and/or plasma uniformly in the process chamber 130, and surface chemistry effects of walls of these holes may be significant.

The elements shown as part of the plasma processing system 100 are listed by way of example and are not exhaustive. Many other possible elements, such as: pressure and/or flow controllers; gas or plasma manifolds or distribution apparatus; ion suppression plates; electrodes, magnetic cores and/or other electromagnetic apparatus; mechanical, pressure, temperature, chemical, optical and/or electronic sensors; wafer or other workpiece handling mechanisms; viewing and/or other access ports; and the like may also be included, but are not shown for clarity of illustration. Internal connections and cooperation of the elements shown within the plasma processing system 100 are also not shown for clarity of illustration. In addition to RF generator 165 and gas(es) 155, other representative utilities such as vacuum pumps 160 and/or general purpose electrical power 170 may connect with the plasma processing system 100. Like the elements shown in the plasma processing system 100, the utilities shown as connected with the plasma processing system 100 are intended as illustrative rather than exhaustive; other types of utilities such as heating or cooling fluids, pressurized air, network capabilities, waste disposal systems and the like may also be connected with the plasma processing system 100, but are not shown for clarity of illustration. Similarly, while the above description mentions that plasma is ignited within the process chamber 130, the principles discussed below are equally applicable to so-called "downstream" or "remote" plasma systems that create a plasma in a first location and cause the plasma and/or its reaction products to move to a second location for processing.

Certain plasma processes are sensitive to surface conditions in a plasma chamber. In the case of semiconductor processing, process stability and uniformity requirements are exacerbated as device geometries shrink and wafer sizes increase. New equipment (or equipment that has had any chamber components replaced) may entail significant downtime to condition the chamber through simulated processing—that is, performing typical plasma processes without exposing actual workpieces—until acceptable process stability is reached.

Figure 2:
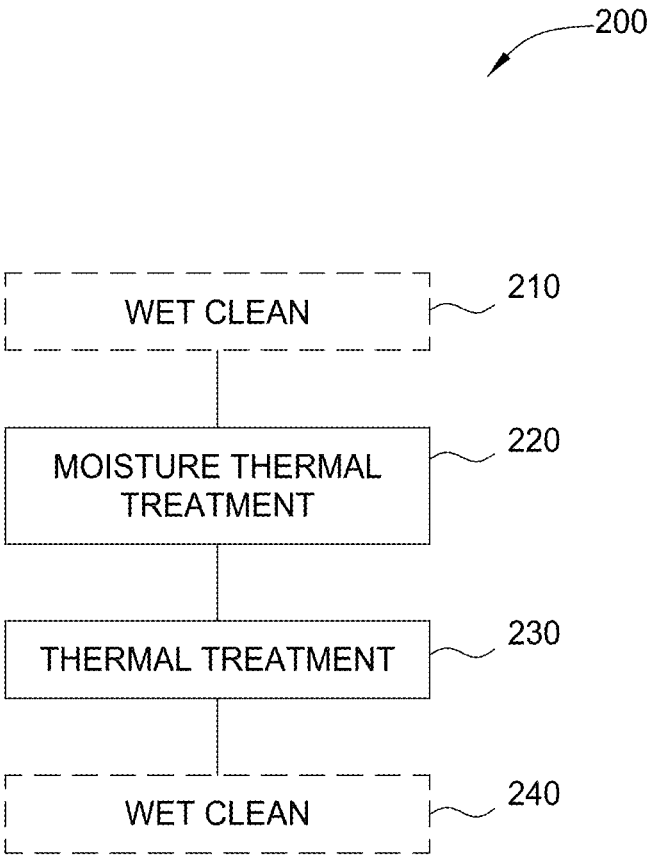
FIG. 2 is a flow chart depicting an exemplary process for forming an alumina passivation layer on an aluminum-containing component.

FIG. 2 is a flow chart depicting an exemplary process 200 for forming an alumina passivation layer on an aluminum-containing component. The process 200 may be used to form a passivation layer on any of the components including the surfaces of the plasma processing system 100 depicted in FIG. 1, for example. The aluminum passivation layer is generally aluminum oxide (e.g., $Al_xO_y$), and often approximately $Al_2O_3$, but variations in the alumina stoichiometry are contemplated and are considered within the scope of this disclosure.

In one implementation, the aluminum-containing component is composed of an aluminum alloy. In one implementation, the aluminum alloy includes magnesium as its major alloying element. One exemplary aluminum alloy that may benefit from the teachings of the present disclosure is 6061 aluminum alloy (aluminum (95.85-98.56% by weight), silicon (0.4-0.8% by weight), iron (0-0.7% by weight), copper (0.15-0.4% by weight), manganese (0-0.15% by weight), magnesium (0.8-1.2% by weight), chromium (0.04-0.35% by weight), zinc (0-0.25% by weight), and titanium (0-0.15% by weight)). Other aluminum alloys may also benefit from the teaching of the present disclosure. The aluminum-containing component may have a natural oxide layer formed on at least one surface of the component. The process 200 is used, for example on an aluminum-containing component that is new or has been treated to remove previous coatings. Certain portions of the process 200 may be performed differently than those shown in the process 200, as described further below.

At operation 210, the aluminum-containing component is optionally exposed to a wet clean process. Any suitable wet clean process for removing residue from the component may be used. In one implementation, an $HNO_3$:HF wet clean process is used. In one implementation, the wet clean solution comprises an aqueous solution of hydrofluoric and nitric acids, in which the hydrofluoric acid may for example, be present in a concentration of 1% by weight, based on the total weight of the solution, and the nitric acid may for example be present in a concentration of 7% by weight, on the same total weight basis. The amount of HF may in general vary from about 0.2% to about 5% by weight, based on the total weight of the solution, and the nitric acid may in general vary from about 5% to about 20% by weight, on the same total weight basis. In one implementation, the weight ratio of $HNO_3$:HF in the wet clean solution is in a range of from 1 to about 100, for example, from about 5 to about 20.

The conditions of the wet clean solution contacting with the aluminum-containing surface may be widely varied in the general practice of the present disclosure. For example, the temperature of the wet clean solution in such contacting step, in one implementation, is in a range of from about 25 degrees Celsius to about 80 degrees Celsius, more preferably from about 30 degree Celsius to about 75 degrees Celsius, and most preferably from about 35 degrees Celsius to about 65 degrees Celsius. The contacting time in the wet clean solution may be varied with the temperature for a given wet clean application being inversely related to the contacting time involved, as well as being functionally related to the type and concentration of the acids in the wet clean solution, and the nature and extent of the contamination of the aluminum-containing surface to be cleaned.

Numerous substitutions and rearrangements of operation 210 will be apparent to one skilled in the art, and all such substitutions and rearrangements are considered to be within the scope of the present disclosure. A few examples of such substitutions and rearrangements are to include a DI water flush and CDA drying steps; to perform any of the CDA drying steps with nitrogen ($N_2$) or other relatively inert gas instead of CDA; to utilize heated CDA (or other relatively inert gas) to promote drying; and/or to shorten or lengthen the DI water flush or CDA drying steps.

At operation 220, the aluminum-containing component is exposed to a moisture thermal treatment process. Not to be bound by theory but it is believed that the moisture thermal treatment process forms an $Al(OH)_3$/AlOOH layer on the aluminum surface of the aluminum-containing component. The $Al(OH)_3$/AlOOH layer may be formed by converting the native oxide layer if present. The moisture damages the natural oxide layer on the aluminum surface (e.g., $3H_2O+Al_2O_3=2Al(OH)_3$ and $2H_2O+2Al_2O_3=4AlOOH$). The moisture reacts with the aluminum of the aluminum surface (e.g., $6H_2O+4Al+3O_2=4Al(OH)_3$ and $2H_2O+4Al+3O_2=4AlOOH$).

In one implementation, the moisture thermal treatment process is performed using a suitable moisture thermal treatment method. For example, in some implementations, the $Al(OH)_3$/AlOOH layer may be formed thermally in a water-vapor containing environment, such as in an environment containing ambient air, nitrogen ($N_2$), oxygen ($O_2$), ozone ($O_3$), water vapor ($H_2O$), hydrogen plus oxygen ($H_2+O_2$), an inert gas, or the like. In one implementation, the environment has a moisture content from about 30% to about 100% (e.g., a moisture content from about 40-80%; or a moisture content from about 50-70%).

In one implementation, the $Al(OH)_3$/AlOOH layer is formed from a first process gas comprising at least one of nitrogen ($N_2$), oxygen ($O_2$), ozone ($O_3$), water vapor ($H_2O$), hydrogen plus oxygen ($H_2+O_2$), or the like, and, optionally, an inert gas. The inert gas may include at least one of helium (He), argon (Ar), nitrogen ($N_2$), ammonia ($NH_3$) or the like. In implementations where the process gas includes water vapor ($H_2O$), water vapor may be provided at about 30-100% of the total gas mixture (e.g., from about 40-80% of the total gas mixture; from about 50-70% of the total gas mixture).

The $Al(OH)_3$/AlOOH layer formed at operation 220 may be formed at temperatures of less than or equal to about 100 degrees Celsius. In some implementations, the temperature may be equal to about 80 degrees Celsius or below. In some implementations, the temperature may be from about 30-100 degrees Celsius (e.g., from about 40-50 degrees Celsius; from about 40-90 degrees Celsius; from about 50-80 degrees Celsius; or from about 60-70 degrees Celsius).

In one implementation, the $Al(OH)_3$/AlOOH layer formed by operation 220 has a thickness from about 5 nanometers to about 100 nanometers (e.g., from about 5 nanometers to about 50 nanometers; from about 10 nanometers to about 40 nanometers; from about 20 nanometers to about 30 nanometers; or from about 5 nanometers to about 10 nanometers.)

In one implementation, the aluminum-containing component is exposed to the moisture thermal treatment process of operation 220 for a time period of about two hours to about 100 hours (e.g., about 10 hours to about 20 hours; about 10 hours to about 12 hours; about 20 hours to about 50 hours; or about 30 hours to about 40 hours).

At operation 230, the aluminum-containing component is exposed to a thermal treatment process to form an alumina layer. Not to be bound by theory but it is believed that the thermal treatment process forms an alumina (e.g., $Al_2O_3$) layer on the aluminum surface of the aluminum-containing component (e.g., $2Al(OH)_3 = Al_2O_3+3H_2O$ and $2AlOOH = Al_2O_3+H_2O$).

In one implementation, the thermal treatment process of operation 230 is performed using a suitable thermal treatment method. In one implementation, the thermal treatment process is performed in a moisture-free environment (e.g., having a moisture content of less than 1%; or having a moisture content of less than 0.1%) or low moisture environment (e.g., having a moisture content of less than 10%). For example, in some implementations, the alumina layer may be formed thermally in an environment containing ambient air, nitrogen ($N_2$), oxygen ($O_2$), ozone ($O_3$), hydrogen plus oxygen ($H_2+O_2$), an inert gas, or the like.

The alumina layer formed at operation 230 may be formed at temperatures of less than or equal to about 550 degrees Celsius. In some implementations, the temperature is less than or equal to about 450 degrees Celsius or below (e.g., less than or equal to about 350 degrees Celsius or below; less than or equal to about 250 degrees Celsius or below). In some implementations, the temperature is from about 200-550 degrees Celsius (e.g., from about 300-500 degrees Celsius; from about 350-450 degrees Celsius; or from about 350 degrees Celsius and about 400 degrees Celsius).

In one implementation, the aluminum-containing component is exposed to the thermal treatment process of operation 230 for a time period of about two hours to about 100 hours (e.g., about 10 hours to about 20 hours; about 10 hours to about 12 hours; about 20 hours to about 50 hours; or about 30 hours to about 40 hours).

In one implementation, the $Al(OH)_3$/AlOOH layer formed by operation 220 has a thickness from about 100 nanometers to about 10 micrometers (e.g., from about 100 nanometers to about 1,000 nanometers; from about 200 nanometers to about 500 nanometers; from about 300 nanometers to about 400 nanometers; or from about 1 micrometer to about 10 micrometers.)

In one implementation, the alumina layer is a compact (e.g., dense) and non-porous layer.

At operation 240, the component having the alumina layer formed thereon is optionally exposed to a wet clean process. Any suitable wet clean process for removing residue from the component may be used. The wet clean process performed at operation 240 may be the same as the wet clean process performed at operation 210.

EXAMPLES

The following non-limiting examples further illustrate implementations described herein. However, the examples are not intended to be all-inclusive and are not intended to limit the scope of the implementations described herein.

Figure 3B:
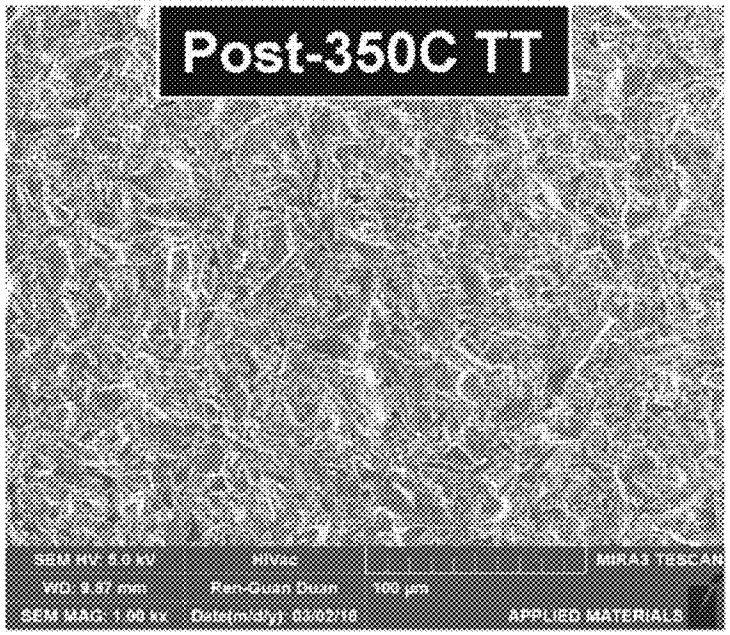
FIG. 3B is a SEM image showing the aluminum surface of depicted in FIG. 3A after exposure to a temperature of about 350 degrees Celsius using standard thermal treatment conditions.
Figure 3A:
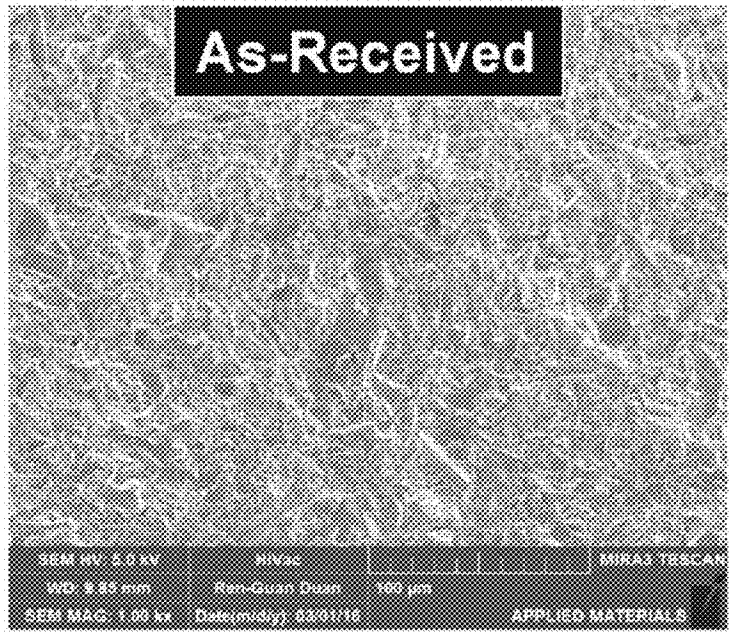
FIG. 3A is a scanning electron microscopy (SEM) image showing an aluminum surface prior to standard thermal treatment.

FIG. 3A is a scanning electron microscopy (SEM) image at 1,000 times magnification showing an aluminum surface of a one inch by one inch aluminum coupon (Aluminum 6061) prior to standard thermal treatment. FIG. 3B is a SEM image at 1,000 times magnification showing the aluminum surface of depicted in FIG. 3A after exposure to a temperature of about 350 degrees Celsius using standard thermal treatment conditions. The aluminum coupon in FIG. 3A is as received out of the package. The aluminum coupon was exposed to a wet clean process prior to packaging. As received the surface of the aluminum coupon had 1.4 atomic percent of magnesium as shown in Table 1.

TABLE 1

| | As-Received | | Post-350° C. TT | |
|---|---|---|---|---|
| Element | Weight % | Atomic % | Weight % | Atomic % |
| C | 1.98 | 4.08 | 1.30 | 2.69 |
| O | 9.42 | 14.54 | 9.59 | 14.86 |
| F | 0.35 | 0.45 | | |
| Mg | 1.42 | 1.45 | 6.12 | 6.24 |
| Al | 86.29 | 79.01 | 82.05 | 75.38 |
| Si | 0.54 | 0.47 | 0.93 | 0.82 |

After thermal treatment at 350 degrees Celsius, the atomic percentage of magnesium increased to 6.2 atomic percent as shown in Table 1.

Figures 5A, 5B, 5C:
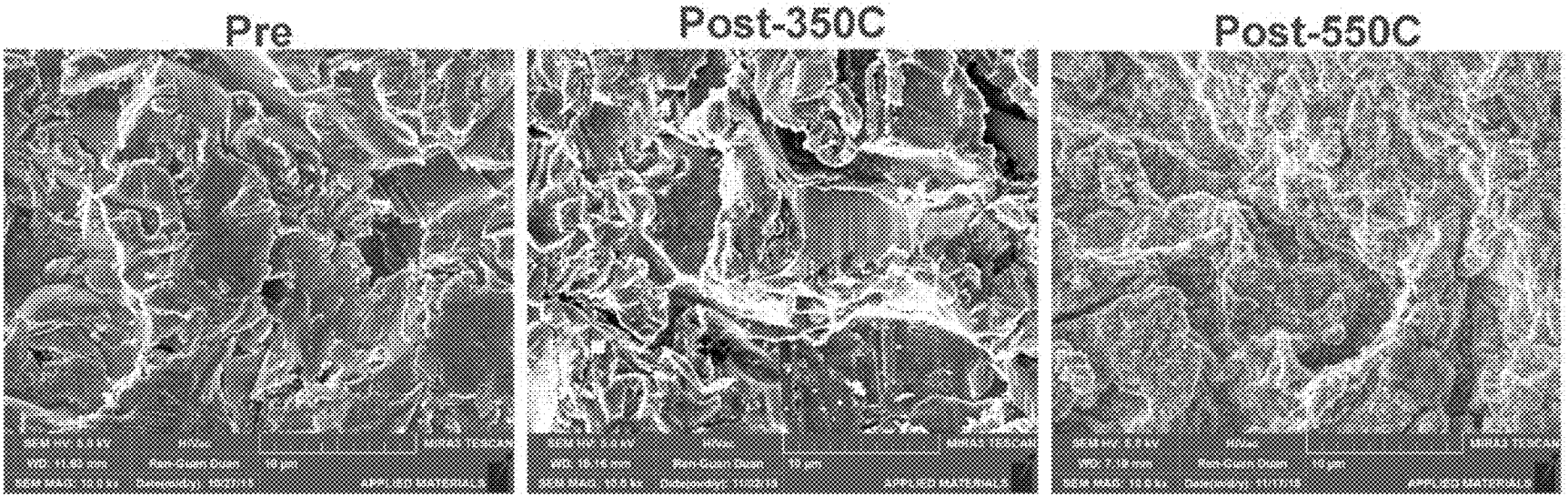
FIG. 5A is a SEM image showing an aluminum surface of a pumping plate prior to standard thermal treatment.
FIG. 5B is a SEM image showing the aluminum surface of the pumping plate depicted in FIG. 5A after exposure to temperatures of 350 degrees Celsius using standard thermal treatment conditions.
FIG. 5C is a SEM image showing the aluminum surface of the pumping plate depicted in FIG. 5B after exposure to temperatures of 550 degrees Celsius using standard thermal treatment conditions.

FIG. 5A is a SEM image at 10,000 times magnification showing an aluminum surface of a pumping plate prior to standard thermal treatment. FIG. 5B is a SEM image at 10,000 times magnification showing the aluminum surface of the pumping plate depicted in FIG. 5A after exposure to temperatures of 350 degrees Celsius using standard thermal treatment conditions. FIG. 5C is a SEM image at 10,000 times magnification showing the aluminum surface of the pumping plate depicted in FIG. 5B after exposure to temperatures of 550 degrees Celsius using standard thermal treatment conditions. As received the surface of the aluminum coupon had 1.4 atomic percent of magnesium as shown in Table 3. As the temperature of the standard thermal treatment increased from 350 degrees Celsius to 550 degrees Celsius the atomic percent of magnesium migrating to the surface of the pumping plate increased from 6.2 atomic percent to about 47.0 atomic percent as shown in Table 3.

TABLE 3

| | As-Received | | Post-350° C. | | Post-550° C. | |
|---|---|---|---|---|---|---|
| Element | Weight % | Atomic % | Weight % | Atomic % | Weight % | Atomic % |
| C | 2.21 | 4.54 | 1.30 | 2.69 | 1.63 | 2.87 |
| O | 9.27 | 14.30 | 9.59 | 14.86 | 28.70 | 37.91 |
| Mg | 1.41 | 1.43 | 6.12 | 6.24 | 54.12 | 47.04 |
| Al | 86.68 | 79.34 | 82.05 | 75.38 | 15.31 | 11.99 |
| Si | 0.44 | 0.39 | 0.93 | 0.82 | 0.24 | 0.18 |

Figure 4A:
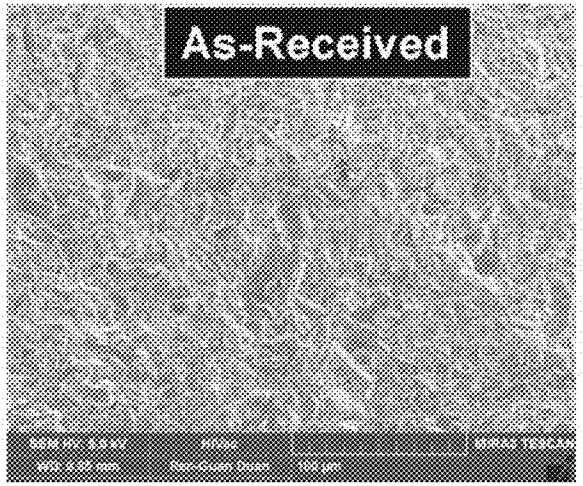
FIG. 4A is a SEM image showing an aluminum surface prior to moisture thermal treatment.
Figure 4B:
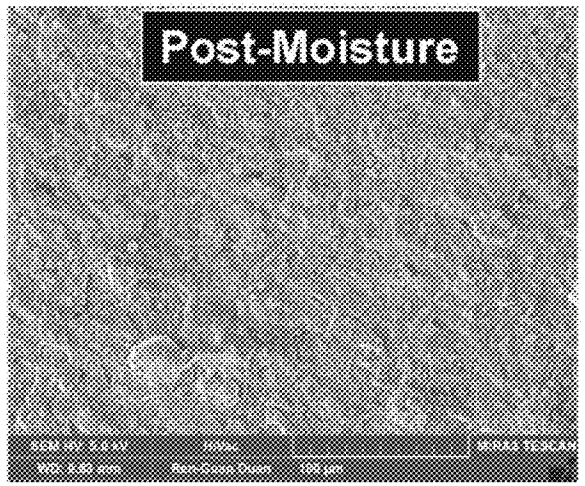
FIG. 4B is a SEM image showing the aluminum surface depicted in FIG. 4A after exposure to moisture, according to implementations described herein.
Figure 4C:
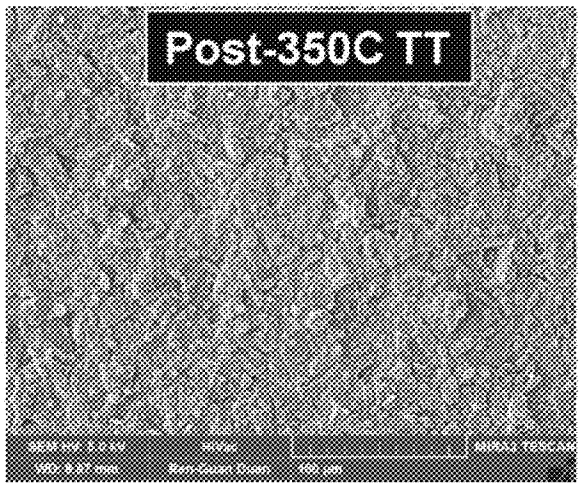
FIG. 4C is a SEM image showing the aluminum surface depicted in FIG. 4B after exposure to temperatures of 350 degrees Celsius, according to implementations described herein.

FIG. 4A is a SEM image at 1,000 times magnification showing an aluminum surface of a one inch by one inch aluminum coupon (Aluminum 6061) prior to moisture thermal treatment. FIG. 4B is a SEM image at 1,000 times magnification showing the aluminum surface depicted in FIG. 4A after exposure to moisture, according to implementations described herein. FIG. 4C is a SEM image at 1,000 times magnification showing the aluminum surface depicted in FIG. 4B after exposure to temperatures of 350 degrees Celsius, according to implementations described herein. As received (see FIG. 4A) the surface of the aluminum coupon had 1.4 atomic percent of magnesium as shown in Table 2. After moisture treatment (see FIG. 4B) at 80 degrees Celsius in an atmosphere of about 100% water vapor, the atomic percentage of magnesium decreased to 0 atomic percent as shown in Table 2. The atomic percentage of magnesium was maintained at 0 atomic percent after thermal treatment at 350 degrees Celsius to form an alumina layer as shown in Table 2. The dense alumina layer blocked magnesium from migrating out of the aluminum alloy coupon.

TABLE 2

| | As-Received | | Post-Moisture | | Post-350° C. TT | |
|---|---|---|---|---|---|---|
| Element | Weight % | Atomic % | Weight % | Atomic % | Weight % | Atomic % |
| C | 1.98 | 4.08 | 2.54 | 4.13 | 3.34 | 5.62 |
| O | 9.42 | 14.54 | 50.83 | 62.09 | 41.85 | 52.95 |
| F | 0.35 | 0.45 | | | 0.92 | 0.98 |
| Mg | 1.42 | 1.45 | | | | |
| Al | 86.29 | 79.01 | 46.63 | 33.78 | 53.90 | 40.44 |
| Si | 0.54 | 0.47 | | | | |

Figure 6A:
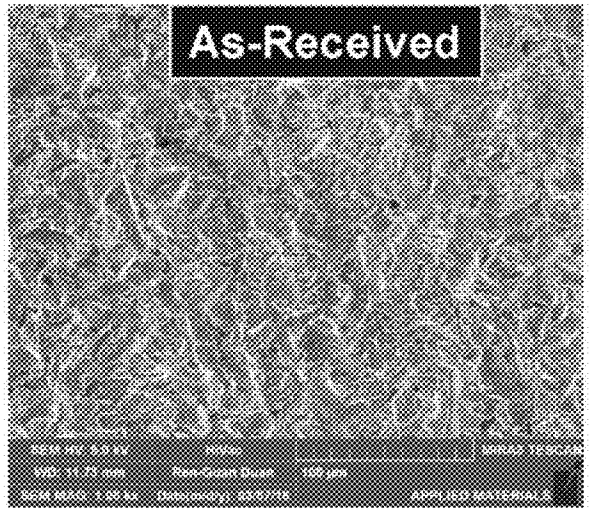
FIG. 6A is a SEM image showing an aluminum surface of a pumping plate prior to moisture thermal treatment.
Figure 6B:
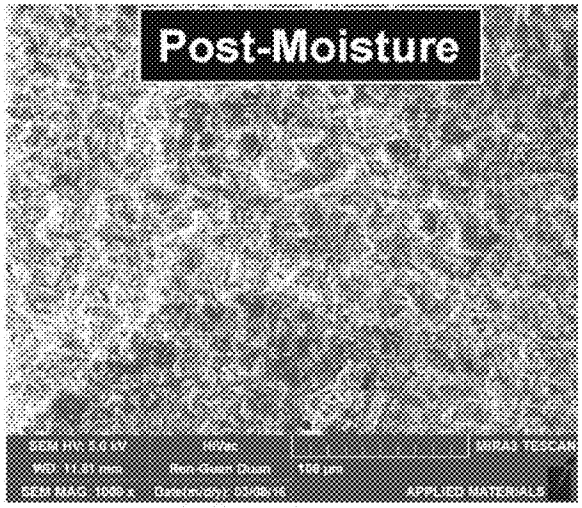
FIG. 6B is a SEM image showing the aluminum surface of the pumping plate depicted in FIG. 6A after exposure to moisture, according to implementations described herein.
Figure 6C:
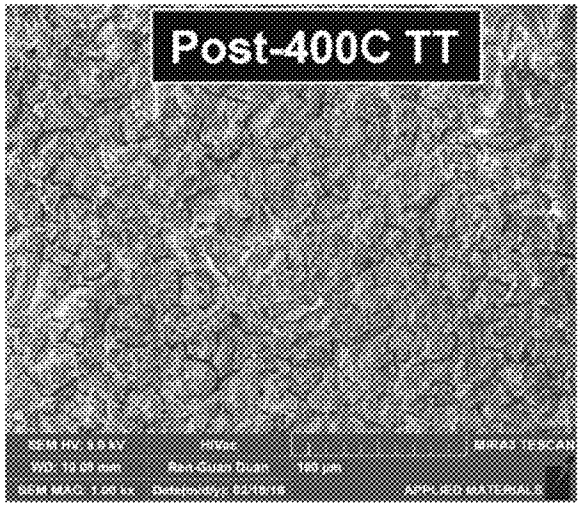
FIG. 6C is a SEM image showing the aluminum surface of the pumping plate depicted in FIG. 6B after exposure to temperatures of 400 degrees Celsius, according to implementations described herein.

FIG. 6A is a SEM image at 1,000 times magnification showing an aluminum surface of a pumping plate prior to moisture thermal treatment. FIG. 6B is a SEM image at 1,000 times magnification showing the aluminum surface of the pumping plate depicted in FIG. 6A after exposure to moisture, according to implementations described herein. FIG. 6C is a SEM image at 1,000 times magnification showing the aluminum surface of the pumping plate depicted in FIG. 6B after exposure to temperatures of 400 degrees Celsius, according to implementations described herein. As received the aluminum surface of the pumping plate had 1.2 atomic percent of magnesium. After moisture treatment at 80 degrees Celsius in an atmosphere of about 100% water vapor, the atomic percentage of magnesium decreased to 0 atomic percent as shown in FIG. 6B and Table 4. The atomic percentage of magnesium was maintained at 0 atomic percent after thermal treatment at 440 degrees Celsius to form an alumina layer. The dense alumina layer blocked magnesium from migrating out of the aluminum alloy pumping plate.

TABLE 4

| | As-Received | | Post-Moisture | | Post-400° C. TT | |
|---|---|---|---|---|---|---|
| Element | Weight % | Atomic % | Weight % | Atomic % | Weight % | Atomic % |
| C | 2.26 | 4.62 | 2.21 | 3.60 | 1.71 | 2.94 |
| O | 10.37 | 15.89 | 51.34 | 62.75 | 41.50 | 53.58 |
| Mg | 1.17 | 1.18 | | | | |
| Al | 85.73 | 77.90 | 46.05 | 33.38 | 56.79 | 43.48 |
| Si | 0.46 | 0.40 | 0.40 | 0.28 | | |

Figure 7B:
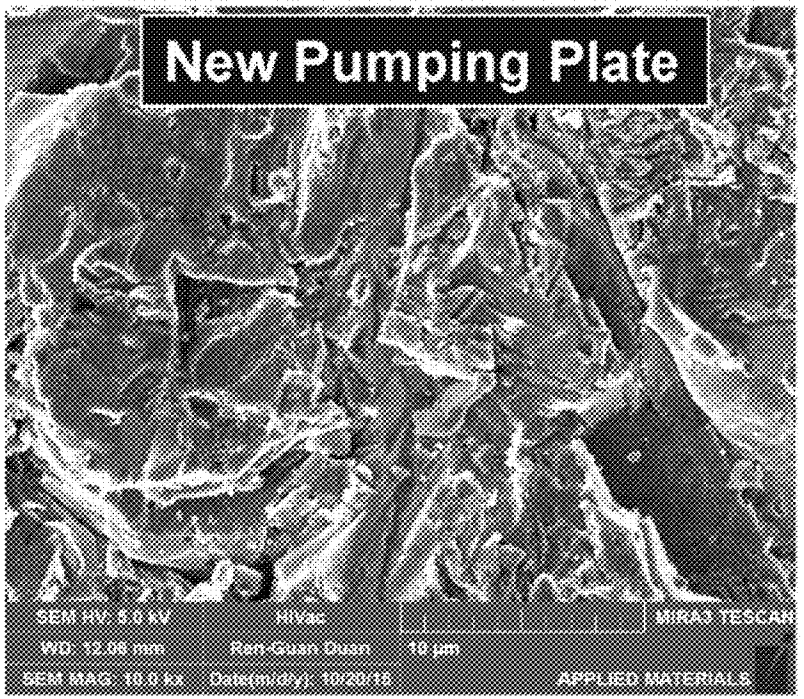
FIG. 7B is a SEM image showing the aluminum surface of a new pumping plate.
Figure 7A:
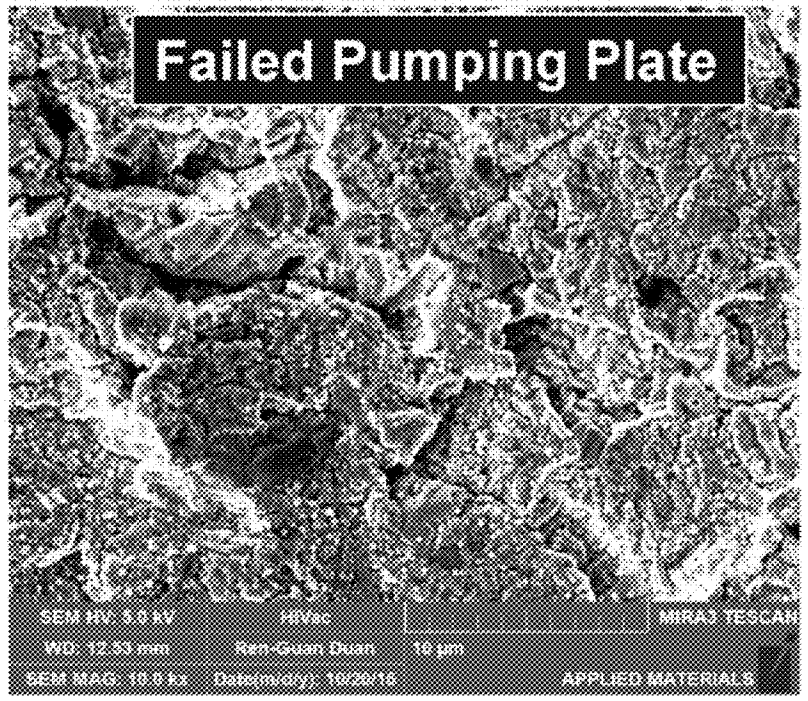
FIG. 7A is a SEM image showing the aluminum surface of a failed pumping plate.

FIG. 7A is a SEM image at 10,000 times magnification showing the aluminum surface of a failed pumping plate. FIG. 7B is a SEM image at 10,000 times magnification showing the aluminum surface of a new pumping plate. FIG. 7A and 7B demonstrate that there is a much higher content of magnesium and oxygen on the surface of a used pumping plate as opposed to the surface of a new pumping plate (see Table 5).

TABLE 5

| | Failed Pumping Plate | | New Pumping Plate | |
|---|---|---|---|---|
| Element | Weight % | Atomic % | Weight % | Atomic % |
| C | 3.38 | 6.02 | 3.61 | 7.17 |
| O | 24.93 | 33.32 | 11.87 | 17.71 |
| F | 1.05 | 1.19 | 0.47 | 0.59 |
| Mg | 40.70 | 35.80 | 1.36 | 1.33 |
| Al | 28.41 | 22.52 | 82.70 | 73.19 |
| Si | 1.53 | 1.16 | | |

Figure 8A:
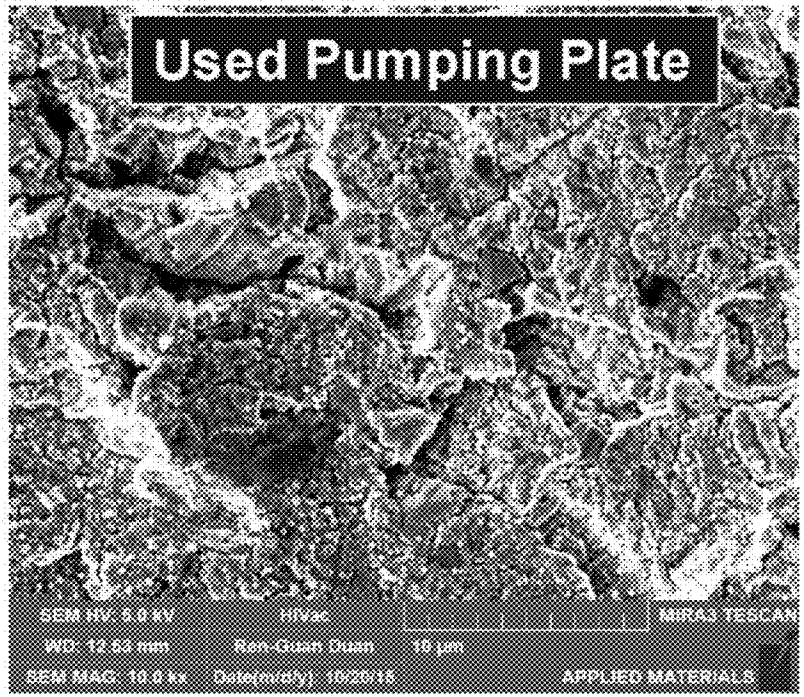
FIG. 8A is a SEM image showing the aluminum surface of a failed pumping plate.
Figure 8B:
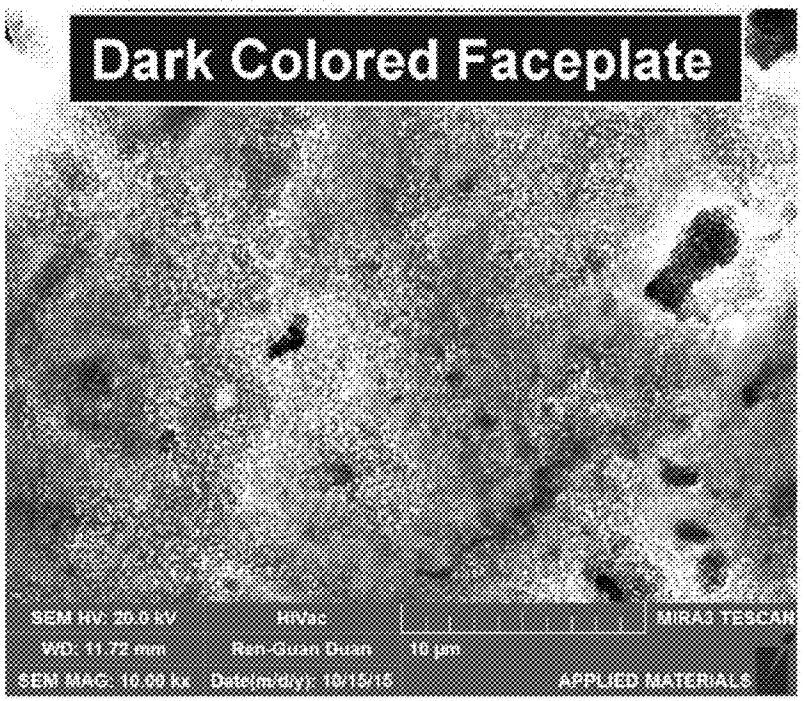
FIG. 8B is a SEM image showing the aluminum surface of a used faceplate.

FIG. 8A is a SEM image at 10,000 times magnification showing the aluminum surface of a failed pumping plate. FIG. 8B is a SEM image at 10,000 times magnification showing the aluminum surface of a used faceplate. FIGS. 8A and 8B demonstrate a higher content of magnesium and oxygen on the surface of a used pumping plate as opposed to the surface of a faceplate (see Table 6).

TABLE 6

| | Used Pumping Plate | | Dark Color Faceplate | |
|---|---|---|---|---|
| Element | Weight % | Atomic % | Weight % | Atomic % |
| C | 3.38 | 6.02 | 13.55 | 23.34 |
| O | 24.93 | 33.32 | 15.42 | 19.94 |
| F | 1.05 | 1.19 | 0.73 | 0.79 |
| Na | | | 3.06 | 2.75 |
| Mg | 40.70 | 35.80 | 19.07 | 16.23 |
| Al | 28.41 | 22.52 | 48.09 | 36.88 |
| Si | 1.53 | 1.16 | 0.09 | 0.06 |

In summary, some of the benefits of the present disclosure include forming an alumina layer for reducing migration of magnesium from an aluminum alloy component during high temperature processing. Since the alumina layer forms using a moisture thermal treatment process and moisture can be present on both the surfaces of the component as well as within smaller features of the component, the alumina layer forms both on flat surfaces and on surfaces within small diameter features. In addition, the alumina layer described herein increases component lifetime and reduces particle & contamination problems.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is encompassed within the present disclosure, subject to any specifically excluded limit in the stated range. Where the stated range includes one or both of the limits, ranges excluding either or both of those included limits are also included.

As used herein and in the appended claims, the singular forms "a", "an," and "the" include plural referents unless the context clearly dictates otherwise. Thus, for example, reference to "a process" includes a plurality of such processes and reference to "the electrode" includes reference to one or more electrodes and equivalents thereof known to those skilled in the art, and so forth. Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

While the foregoing is directed to implementations of the present disclosure, other and further implementations of the disclosure may be devised without departing from the basic scope thereof, and the scope thereof is determined by the claims that follow.

The invention claimed is:

1. A process, comprising:

exposing at least one surface of an aluminum-containing component to a moisture thermal treatment process comprising exposing the aluminum-containing component to an environment having a moisture content from 30% to 100% at a first temperature from 30 to 100 degrees Celsius; and exposing the at least one surface of the aluminum-containing component to a thermal treatment process comprising heating the aluminum-containing component to a second temperature from 200 degrees Celsius to 550 degrees Celsius to form an alumina layer on the at least one surface of the aluminum-containing component, wherein the aluminum-containing component is a diffuser plate having one or more holes having a diameter from 16 mils to 0.5 millimeters, the at least one surface is an inner surface of one of the one or more holes, and the aluminum-containing component is composed of an aluminum alloy comprising magnesium.

2. The process of claim 1, wherein the aluminum-containing component has an oxide layer formed on the at least one surface prior to the moisture thermal treatment process.

3. The process of claim 1, wherein the first temperature is between 50 to 80 degrees Celsius.

4. The process of claim 3, wherein the second temperature is from 350 degrees Celsius and 400 degrees Celsius.

5. The process of claim 4, wherein the moisture content is from 50-70%.

6. The process of claim 1, wherein the environment comprises water ($H_2O$) vapor.

7. The process of claim 6, wherein the thermal treatment process is performed in a moisture-free environment.

8. A process, comprising:

exposing at least one surface of an aluminum-containing component to a first wet clean solution including nitric acid ($HNO_3$) and hydrofluoric acid (HF);

exposing the at least one surface of the aluminum-containing component to a moisture thermal treatment process comprising exposing the aluminum-containing component to an environment having a moisture content from 30% to 100% at a first temperature from 30 to 100 degrees Celsius; and exposing the at least one surface of the aluminum-containing component to a thermal treatment process comprising heating the aluminum-containing component to a second temperature from 200 degrees Celsius to 550 degrees Celsius to form an alumina layer on the at least one surface of the aluminum-containing component, wherein the aluminum-containing component is a diffuser plate having one or more holes having a diameter from 16 mils to 0.5 millimeters, the at least one surface is an inner surface of one of the one or more holes, and the aluminum-containing component is composed of an aluminum alloy comprising magnesium.

9. The process of claim 8, wherein the first temperature is between 50 to 80 degrees Celsius.

10. The process of claim 9, wherein the second temperature is from 350 degrees Celsius and 400 degrees Celsius.

11. The process of claim 10, wherein the moisture content is from 50-70%.

12. The process of claim 8, wherein the environment comprises water ($H_2O$) vapor.

13. The process of claim 8, further comprising exposing the at least one surface of the aluminum-containing component to a second wet clean solution including nitric acid ($HNO_3$) and hydrofluoric acid (HF) after the thermal treatment process.

14. A process, comprising:

exposing at least one surface of an aluminum-containing component to a first wet clean solution including nitric acid ($HNO_3$) and hydrofluoric acid (HF);

exposing the at least one surface of the aluminum-containing component to a moisture thermal treatment process comprising exposing the aluminum-containing component to an environment having a moisture content from 30% to 100% at a first temperature from 30 to 100 degrees Celsius, wherein exposing the at least one surface of the aluminum-containing component to the moisture thermal treatment process forms an $Al(OH)_3$/AlOOH layer on the at least one surface of the aluminum-containing component; and exposing the at least one surface of the aluminum-containing component to a thermal treatment process comprising heating the aluminum-containing component to a second temperature from 200 degrees Celsius to 550 degrees Celsius to form an alumina layer on the at least one surface of the aluminum-containing component, wherein the thermal treatment process converts at least a portion of the $Al(OH)_3$/AlOOH layer to the alumina layer, wherein the aluminum-containing component is a diffuser plate having one or more holes having a diameter from 16 mils to 0.5 millimeters, the at least one surface is an inner surface of one of the one or more holes, and the aluminum-containing component is composed of an aluminum alloy comprising magnesium.

15. The process of claim 14, wherein the first temperature is between 50 to 80 degrees Celsius.

16. The process of claim 15, wherein the second temperature is from 350 degrees Celsius and 400 degrees Celsius.

17. The process of claim 16, wherein the moisture content is from 50-70%.

18. The process of claim 14, wherein the environment comprises water ($H_2O$) vapor.

19. The process of claim 14, further comprising exposing the at least one surface of the aluminum-containing component to a second wet clean solution including nitric acid ($HNO_3$) and hydrofluoric acid (HF) after the thermal treatment process.

* * * * *